US005925975A

United States Patent [19]

Suzuki

[11] Patent Number: 5,925,975

[45] Date of Patent: Jul. 20, 1999

[54] VACUUM MICRODEVICE AND METHOD OF MANUFACTURING THE SAME

[75] Inventor: Kenichiro Suzuki, Tokyo, Japan

[73] Assignee: NEC Corporation, Tokyo, Japan

[21] Appl. No.: 08/824,745

[22] Filed: Mar. 26, 1997

[30] Foreign Application Priority Data

Mar. 27, 1996 [JP] Japan ..... 8-071904

[51] Int. Cl.[6] ..... H01J 1/16; H01J 1/62

[52] U.S. Cl. ..... 313/336; 313/309; 313/351; 313/495; 313/496

[58] Field of Search ..... 313/308, 336, 313/495, 496, 497, 309, 351; 428/426, 131

[56] References Cited

U.S. PATENT DOCUMENTS 4,307,507 12/1981 Gray et al. ..... 29/580

5,332,627 7/1994 Watanabe et al. ..... 428/426

FOREIGN PATENT DOCUMENTS 6-36682 2/1994 Japan .

*Primary Examiner*—Ponnathapura Achutamurthy
*Assistant Examiner*—P. Ponnaluri
*Attorney, Agent, or Firm*—Foley & Lardner

[57] ABSTRACT

A vacuum microdevice includes a first electrode, an insulating film, and a second electrode. The first electrode projects in a current radiation region on a substrate and has a sharp tip. The insulating film is formed on the surface of the first electrode except the tip of the first electrode. The second electrode is formed on the insulating film and has an electrode thickness which increases away from the tip of the first electrode.

7 Claims, 9 Drawing Sheets

VACUUM MICRODEVICE AND METHOD OF MANUFACTURING THE SAME

BACKGROUND OF THE INVENTION

The present invention relates to a vacuum microdevice and, more particularly, to the structure of a field emission cold cathode applied to, e.g., a microminiature microwave vacuum tube and a microminiature display element, and a method of manufacturing the same.

A microminiature field emission cold cathode can be manufactured as a vacuum microdevice by using silicon semiconductor technologies, and several conventional methods are known. To enhance the function of a field emission cold cathode, however, it is necessary to meet material requirements such as the use of an emitter material which has a small work function and hardly changes due to an environment, in addition to satisfying dimensional requirements such as a sharp tip of an emitter and the uniformity of shapes of a plurality of emitters. For this reason, a manufacturing method using the principle of a mold method has attracted attention recently. In this method, a recessed portion with a pointed bottom surface is formed in a silicon substrate, an emitter material is buried in the recessed portion, and the emitter is separated from the silicon substrate. A method of manufacturing a field emission cold cathode using this mold method was first reported in H. F. Grey et al., "Method of Manufacturing a Field-Emission Cathode Structure" (U.S. Pat. No. 4,307,507).

In this mold method, a large number of very small recessed portions can be uniformly formed in a silicon substrate, and processing is facilitated because it is only necessary to bury an emitter material in these recessed portions. Therefore, the method has the advantage that various types of emitter materials can be used. However, the patent to H. F. Grey et al. has the limitation that the thickness of an emitter must be increased since, if the emitter material is a thin film, the strength of the emitter is insufficient when the emitter is separated from the silicon substrate. This prolongs the emitter formation time, and a technique for controlling large stresses remaining in the emitter material is also necessary.

One method capable of manufacturing a cold cathode device by using a thin emitter film is to reinforce the thin emitter film by adhering the film to a structural substrate having a sufficient strength. An example of the manufacture of a triode structure device using this method is described in M. Nakamoto et al., "Manufacture of Field Emission Cold Cathode, Field Emission Cold Cathode Using It, and Flat Image Display" (Japanese Patent Laid-Open No. 6-36682). This prior art will be described below with reference to FIGS. 9 and 10A to 10F. FIG. 9 shows the structure of a field emission cold cathode using the mold method. An emitter electrode 101 having sharp tips in current radiation regions 104 is formed on a glass substrate 100. A gate electrode 103 is formed on the emitter electrode 101 via an oxide film 102.

When a voltage of about 100 V is applied between the gate electrode 103 and the emitter electrode 101, an intense electric field of about $10^9$ V/cm is generated because the tip of the emitter electrode 101 is sharpened in the current radiation region 104. Electrons are emitted from the tip of the emitter electrode 101 due to this intense electric field. Since the current radiation region 104 thus generates an intense electric field, it is required to control the shape of the emitter electrodes and the gate electrodes 103 with high accuracy.

FIGS. 10A to 10F illustrate a method of manufacturing the structure shown in FIG. 9 in the order of steps. As shown in FIG. 10A, holes 116 each having dimensions of 1 $\mu$m×1 $\mu$m×0.7 $\mu$m are formed in a silicon substrate 110 by using an oxide film 111 as a mask. In this formation, holes having the shape of an inverted triangular pyramid can be easily formed by etching the silicon substrate 110 by using a KOH (potassium hydroxide) solution. Subsequently, as shown in FIG. 10B, the silicon substrate 110 is oxidized to form an oxide film 112 about 300 nm thick inside the holes 116. An emitter metal 113 is deposited to have a thickness of about 1 $\mu$m on the oxide film 112. Forming the oxide film 112 in the holes 116 has an effect of sharpening the points of the holes 116. As shown in FIG. 10C, the emitter metal 113 and a glass substrate 100 are adhered by using electrostatic adhesion. The resultant sample is then dipped in a KOH etching solution to completely remove the silicon substrate 110. Since a KOH etching solution has a silicon etching rate approximately 100 times as high as that of an oxide film, the structure shown in FIG. 10C is obtained.

Subsequently, as shown in FIG. 10D, a resist 115 is applied on the surface of a gate metal 114 about 1 $\mu$m thick formed by sputtering. Molybdenum is commonly used as the emitter metal 113 and the gate metal 114. As shown in FIG. 10E, the resist 115 is back-etched under conditions by which the entire surface of the sample is etched at a uniform rate. The back-etch is stopped when the oxide film 112 is exposed in regions 117 where sharp tips are formed. Thereafter, as shown in FIG. 10F, the resist 115 is removed, and the sample is dipped in an HF (hydrogen fluoride) solution to etch the oxide film 112 exposed in the regions 117. Consequently, the tips of the metal 113 as the emitter electrode can be exposed.

SUMMARY OF THE INVENTION

Unfortunately, the structure shown in FIG. 9 and the manufacturing method shown in FIGS. 10A to 10F still have the following problems. First, the gate electrode 103 is flat in a region outside the sharp tip of the emitter electrode 101, but inside the current radiation region 104 the gate electrode 103 obliquely projects inward toward the emitter tip. As described above, before electrons can be emitted from the current radiation region 104 it is necessary to apply a very large electric field ($10^9$ V/cm or more) between this projecting portion of the gate electrode 103 and the sharp tip of the emitter electrode 101. When a large electric field like this is applied, a large electrostatic attraction acts between the projecting end portion of the gate electrode 103 and the sharp tip of the emitter electrode 101, bringing these portions close to each other.

Accordingly, when the gate electrode 103 projects near the tip of the emitter electrode 101 as shown in FIG. 9, the projecting portion of the gate electrode 103 readily deforms because the mechanical rigidity of this portion is small. If the projecting portion of the gate electrode 103 is thus bent toward the tip of the emitter electrode 101, the gate electrode 103 and the emitter electrode 101 come into contact with each other (are electrically short-circuited), the projecting portion of the gate electrode 103 breaks (the device sensitivity is decreases), or the field intensity changes (the device sensitivity is made unstable) due to the deformation of the projecting portion of the gate electrode 103. Especially when this field emission cold cathode is applied to a display, a large number of field emission regions must be formed, so it is necessary to make individual device characteristics uniform and stable.

Second, as shown in FIGS. 10D and 10E, a sputtered gate metal 114 is formed on the oxide film 112 by controlling the back-etch time of the resist 115. However, it is very difficult to uniformly deposit a metal consisting of the gate metal 114 in the vicinity of the sharp tip of the emitter metal 113. That is, unlike when a thin metal film is formed on a flat surface, the sputtered metal atoms unevenly adhere to the substrate in the vicinity of the sharp tip, and growth resulting from internal stress occurs from this uneven portion as a seed. Consequently, the gate metal 114 often forms voids near the sharp tip of the emitter metal 113.

Also, when the resist 115 is applied on the gate metal 114, the resist surface must be planarized. When the sample surface has large projections and recesses as shown in FIG. 10D, the resist 115 must be applied to have a large thickness. When the height of the emitter electrode tip is about 1 $\mu$m, it is necessary to apply the resist 115 about 3 to 5 $\mu$m thick.

The resist surface, however, cannot be completely planarized even by this method. FIG. 10D shows this state in an enlarged scale. This imperfect planarization of the resist surface leads to imperfection of the subsequent etch-back process, preventing complete control of the shape of the projecting portion of the gate metal 114.

The most serious problem of this etch-back process is the timing at which etching of the resist 115 is stopped. Since a region in which the oxide film 112 is exposed is very small (1 $\mu$m×1 $\mu$m or smaller) in each current radiation region 117, it is difficult to detect the end timing of the etch-back process. Therefore, the principal conventional approach is to perform control in accordance with the time determined by test samples. However, this method is unable to avoid large variations in individual samples or in elements in an array, that result from variations of the thickness of the resist 115 or by variations of the etching rate depending upon the apparatus. Since the etching rate also depends upon the size and shape of a sample, it is necessary to measure the etch-back time whenever the device design is changed. Consequently, a long time is required before the manufacturing conditions are obtained.

It is an object of the present invention to provide a vacuum microdevice such as a gate electrode structure field emission cold cathode having a large mechanical rigidity, and a method of manufacturing the same.

It is another object of the present invention to provide a vacuum microdevice which can be easily manufactured without any back-etch process, and a method of manufacturing the same.

According to the present invention, there is provided a vacuum microdevice comprising a first electrode projecting in a current radiation region on a substrate and having a sharp tip, an insulating film formed on a surface of the first electrode except the tip of the first electrode, and a second electrode formed on the insulating film and having an electrode thickness which increases away from the tip of the first electrode.

DESCRIPTION OF THE PREFERRED EMBODIMENTS

The present invention will be described in detail below with reference to the accompanying drawings.

Figure 1:
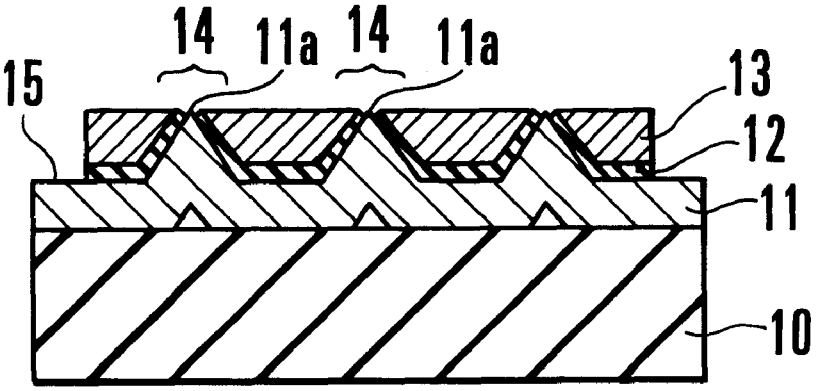
FIG. 1 is a sectional view showing a vacuum microdevice according to the first embodiment of the present invention.

FIG. 1 shows a vacuum microdevice according to the first embodiment of the present invention. For example, an emitter electrode 11 is adhered on a 0.5-mm thick structural substrate 10 such as a glass substrate. This emitter electrode 11 has circular pyramidal portions with sharp tips on a second major surface different from a first major surface adhered to the structural substrate 10. A gate electrode 13 is formed on this second major surface via an insulating film 12. The emitter electrode 11 is made from a material having a small work function, e.g., molybdenum, tantalum, titanium, a nitride of molybdenum/tantalum/titanium, polysilicon, $LaB_5$, or a diamond film. The thickness of the emitter electrode 11 is about 1 $\mu$m. The sharp tip of the emitter electrode 11 has a radius of curvature of 10 nm or less. The insulating film 12 is an oxide film, a nitride film, or an oxide or a nitride of the emitter electrode material, and has a thickness of about 0.3 $\mu$m. The gate electrode 13 is a p- or n-type silicon layer about 1 $\mu$m thick which is made from, e.g., silicon doped with an impurity and having a low resistance.

In the vicinity of a sharp tip 11*a* of the emitter electrode 11, the insulating film 12 covering the emitter electrode 11 is partially removed to expose the sharp tip of the emitter electrode 11, forming a current radiation region 14. In this current radiation region 14, the gate electrode 13 has a flat shape and surrounds the sharp tip lha of the emitter electrode 11. A contact pad 15 where the emitter electrode 11 is exposed to connect a lead wire to the emitter electrode 11 is formed in the outer periphery of the device. This contact pad 15 is formed on the same surface of the structural substrate 10 where the emitter electrode 11 is formed. Therefore, when the rear surface of the structural substrate 10 is adhered to a package, the emitter electrode 11 and the gate electrode 13 can be electrically connected to the pins of the package. This is advantageous in simplifying mounting of the device.

Figure 2:
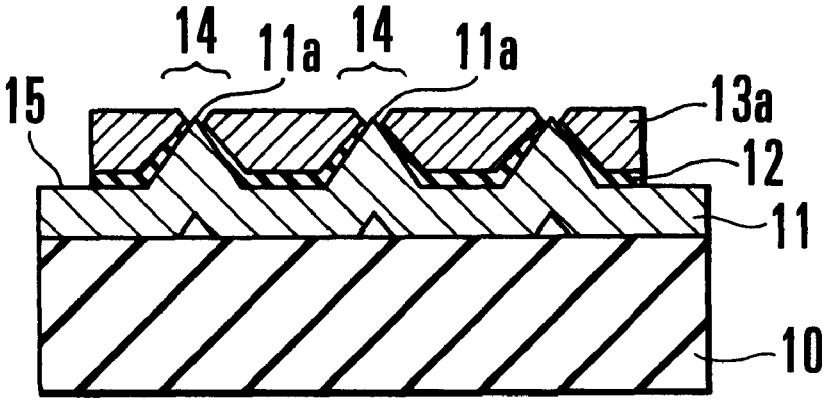
FIG. 2 is a sectional view showing a vacuum microdevice according to the second embodiment of the present invention.

FIG. 2 shows a vacuum microdevice according to the second embodiment of the present invention. This second embodiment is the same as the first embodiment shown in FIG. 1 except for the shape of a gate electrode 13*a* in a current radiation region 14. That is, the thickness of the gate electrode 13*a* formed outside the current radiation region 14 is constant. However, inside the current radiation region 14 the height of the gate electrode 13*a* decreases toward a sharp tip 11*a* of an emitter electrode 11. In both of the structures shown in FIGS. 1 and 2, the gate electrodes 13 and 13*a* have a height equal to or larger than the height of the sharp tip 11*a* of the emitter electrode 11. Therefore, inside the current radiation region 14 the gate electrode 13 has a thickness larger than the thickness of a conventional gate electrode and is so tapered that the thickness increases away from the sharp tip 11*a* of the emitter electrode 11. This greatly increases the mechanical rigidity.

In the above structures, silicon containing highly doped boron, n-type silicon, or p-type silicon is suitable as the material of the gate electrodes 13 and 13*a* provided that the manufacturing methods to be described later are used. Also, glass (particularly borosilicate glass) is suitable as the structural substrate 10 because metal-glass electrostatic adhesion can be used.

In the structures shown in FIGS. 1 and 2 as described above, the gate electrode 13 formed to surround the sharp tip 11*a* of the emitter electrode 11 has a tapered structure in which the thickness increases from the sharp tip of the emitter electrode 11 toward the outer periphery, instead of a conventional projecting structure which readily deforms. In the structure shown in FIG. 1, therefore, the hole of the gate electrode 13 smoothly connects to the gate electrode surface in a region where the emitter electrode 11 is not exposed. In the structure shown in FIG. 2, in the hole of the gate electrode 13*a* the height of the gate electrode 13*a* decreases toward the sharp tip 11*a* of the emitter electrode 11. When a large electric field acts on the gate electrode 13 (13*a*) having the above shape from the sharp tip 11*a* of the emitter electrode 11, an in-plane tensile stress is produced in the gate electrode 13 (13*a*).

Generally, the rigidity of a structure with respect to an in-plane tensile stress is much larger than the rigidity in bending of a conventional structure. Since, therefore, the mechanical rigidity of the gate electrode increases in the current radiation region, deformation of the gate electrode can be well suppressed even if a large electric field acts in the current radiation region. This stabilizes the device characteristics.

Various methods of manufacturing the structures shown in FIGS. 1 and 2 will be described below with reference to the accompanying drawings.

Figure 3A:
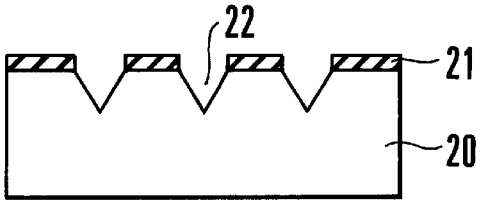
FIGS. 3A to 3F are sectional views showing the first example of a vacuum microdevice manufacturing method of the present invention.

FIGS. 3A to 3F illustrate the first example of a vacuum microdevice manufacturing method according to the present invention. As shown in FIG. 3A, an oxide film 21 is selectively formed on a silicon substrate 20, and holes having dimensions of, e.g., 1 $\mu$m×1 $\mu$m are formed by using the oxide film 21 as a mask. The silicon substrate 20 is etched by using an anisotropic etching solution such as KOH or hydrazine, forming mold holes 22 having the shape of an inverted triangular pyramid.

Figure 3B:
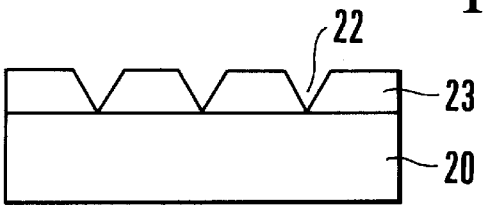

Subsequently, as shown in FIG. 3B, the oxide film 21 is completely removed from the silicon substrate 20, and boron is diffused at a high concentration into the major surface of the silicon substrate 20 in which the mold holes 22 are formed, thereby forming a B diffusion layer 23. This high-concentration diffusion of boron can be accomplished by opposing a solid source to the major surface in which the mold holes 22 are formed and heating the source at a temperature of about 1200° C. in an atmosphere containing nitrogen gas and oxygen mixed at a flow rate of about 3 to 10% of the flow rate of the nitrogen gas.

The characteristic feature of this manufacturing method is that boron diffuses at a low concentration at the sharp point of the bottom of the mold hole 22. This phenomenon is generally unknown and found by the present inventors during the course of experiments. One notable feature of the present invention is to apply this novel phenomenon to the manufacture of a vacuum microdevice.

Possible reasons why boron hardly diffuses at the point of the mold hole are as follows. First, in diffusion using a solid source, an oxide film ($B_2O_3$) containing heavily doped boron is first formed on the surface of the silicon substrate 20 and serves as a source for diffusing boron into the silicon substrate 20. However, since oxygen gas does not evenly diffuses in a very small hole, the concentration of oxygen gas at the bottom of the mold hole 22 becomes lower than that near the entrance. Consequently, the thickness of the oxide film (boron diffusion source) containing highly doped boron decreases at the bottom of the mold hole 22.

Second, an oxide film has a boron segregation coefficient larger than that of silicon. Therefore, when boron is drawn from the silicon substrate 20 into the oxide film in the subsequent mold hole oxidation process (FIG. 3C), boron is also drawn from the vicinity of the point of the mold hole 22 into the oxide film. This further decreases the boron concentration near the point of the mold hole. Third, boron diffusion produces a large strain between the silicon substrate 20 and the oxide film formed at the point of the mold hole 22, and this suppresses the diffusion of boron. The combined effect of the above three causes is considered responsible for the decrease in the boron concentration at the point of the mold hole 22.

After the solid source diffusion, the surface of the silicon substrate 20 is covered with the oxide film 21 containing heavily doped boron and having a thickness of about 100 nm. Therefore, it is necessary to completely remove the oxide film by using hydrofluoric acid. This step is important to form an emitter electrode having sharp tips. This is so because an oxide film containing boron has a low melting point and flows at about 700° C. particularly in an atmosphere containing hydrogen, and as a consequence the points of the mold holes 22 are rounded in the subsequent mold hole oxidation process (FIG. 3C).

Figure 3C:
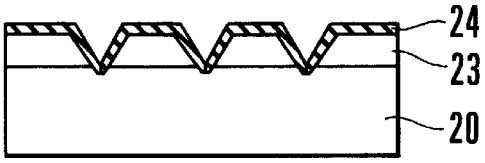
Figure 3D:
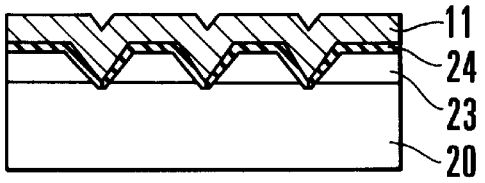
Figure 3E:
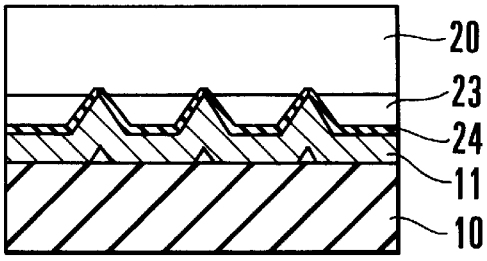

In FIG. 3C, the sample is placed in an electric oven, and an oxide film 24 is formed on the silicon substrate 20 on which the B diffusion layer 23 is formed. In FIG. 3D, an emitter electrode 11 is deposited on the oxide film 24. In FIG. 3E, the surface of the silicon substrate 20 on which the emitter electrode 11 is formed is adhered to one surface of a structural substrate 10.

If the structural substrate 10 is made from a glass material, the glass and the emitter electrode 11 can be strongly adhered by using an electrostatic adhesion method. Since a large adhesion strength can be obtained by this electrostatic adhesion, deformation of the emitter electrode 11 can be decreased when the emitter electrode 11 is separated from the silicon substrate 20 in a subsequent step. Also, when borosilicate glass (e.g., Corning #7740) is used as the material of the glass substrate 10 and, e.g., tantalum or molybdenum is used as the material of the emitter electrode 11, a less strained device can be obtained because the thermal expansion coefficients of these two materials are close. When an emitter electrode material with a thermal expansion coefficient largely different from that of the glass substrate 10 is used, a film of, e.g., tantalum, molybdenum, or silicon is formed as an adhesion layer on the emitter electrode 11 after the emitter electrode 11 is formed in the step of FIG. 3D. This allows easy adhesion to the glass substrate 10.

Figure 3F:
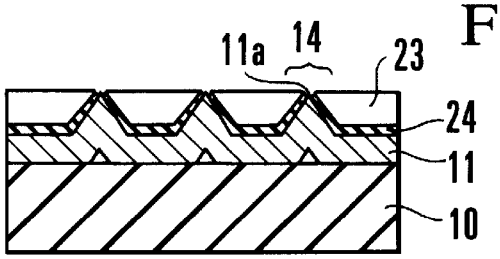

Subsequently, as shown in FIG. 3F, the silicon substrate 20 is removed while the B diffusion layer 23 is left behind by placing the sample in a solution, e.g., a hydrazine solution, whose etching rate depends upon the boron concentration. Those projecting end portions of the oxide film 24 that are exposed in current radiation regions 14 are removed by using hydrofluoric acid to expose sharp tips 11*a* of the emitter electrode 11.

A contact pad 15 is formed by one of the following two methods. In the first method, before the boron diffusion shown in FIG. 3B is performed the oxide film 21 is selectively left behind only in a region where the contact pad 15 is to be formed. The remaining oxide film 21 is used as a mask to prevent boron from diffusing into the silicon substrate 20. As a consequence, silicon in the contact pad region is removed to form a region where the oxide film 24 is exposed in the silicon etching step shown in FIG. 3F. This oxide film 24 is removed in the same step as the step of exposing the tips 11*a* of the emitter electrode 11, and the contact pad 15 is formed.

In the second method, a resist pattern having a hole in a contact pad region is formed after the silicon etching step shown in FIG. 3F, and, e.g., a dry etching apparatus is used to selectively etch the B diffusion layer 23 by using a gas such as $SF_6$. Thereafter, the resist pattern is removed, and the oxide film 24 in the exposed region is removed by using hydrofluoric acid.

Note that thermal diffusion using a solid source is used to form the highly doped B diffusion layer 23 in the step shown in FIG. 3B, but the B diffusion layer 23 can also be formed by using ion implantation. However, the utmost care should be taken when performing ion implantation. If ion implantation is carelessly done, a large amount of boron is implanted into the points of the mold holes 22, and this makes it difficult to expose the sharp tips 11*a* of the emitter electrode 11.

Figure 4:
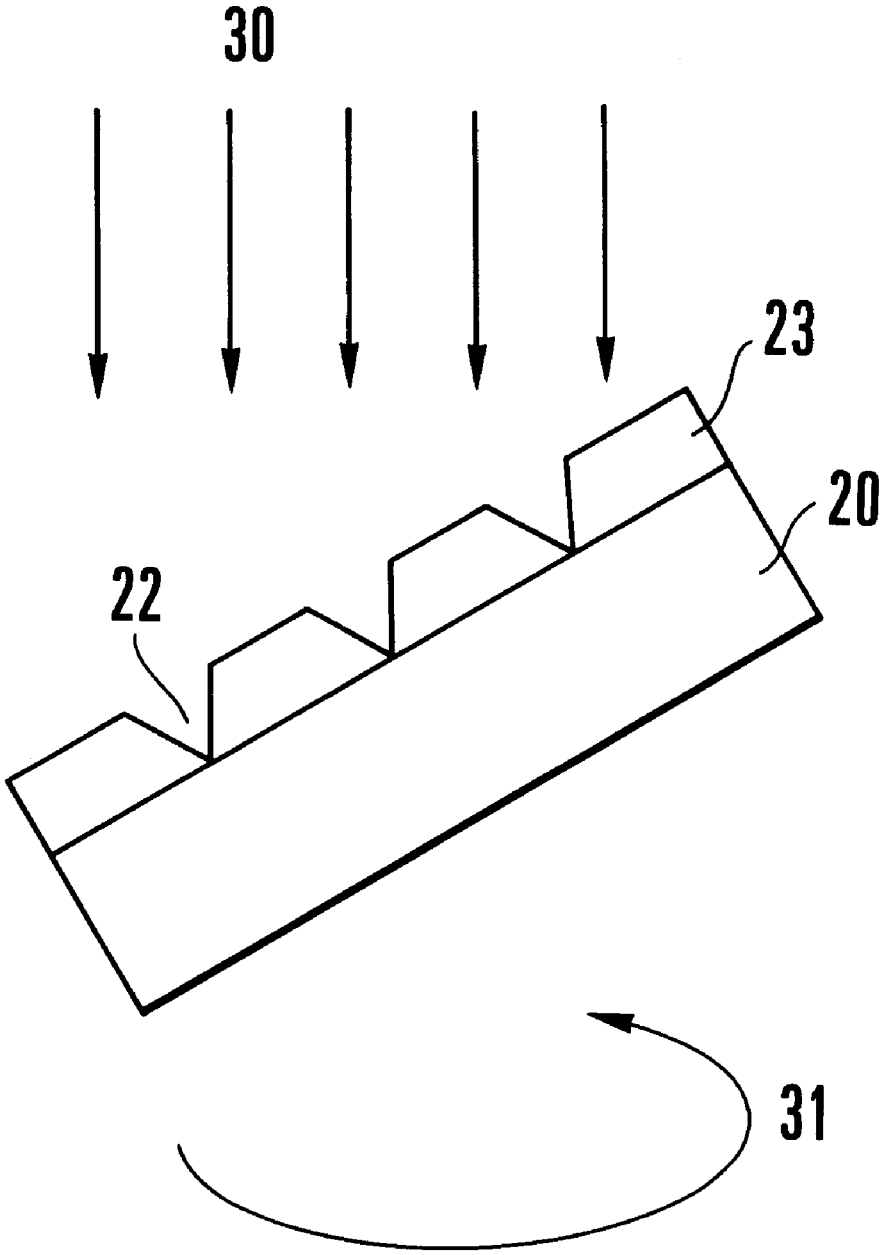
FIG. 4 is a sectional view for explaining another example of the step shown in FIG. 3B.

FIG. 4 shows another example of the step shown in FIG. 3B. As shown in FIG. 4, after the oxide film 21 is removed from the surface in the step shown in FIG. 3A, the normal to the major surface of the silicon substrate 20 in which the mold holes 22 are formed is inclined toward the implantation direction of boron ions 30 emitted from an ion implantation apparatus. At the same time, the sample is rotated as indicated by an arrow 31 about the implantation direction of the boron ions 30. The inclination angle of the silicon substrate 20 with respect to the implantation direction of the boron ions 30 is 1 to 55 degrees. By changing this inclination angle, it is possible to change the size of a region where the heavily doped B diffusion layer 23 is not formed at the point of the mold hole 22. To shorten the implantation time, boron implantation is desirably performed with a dose of $10^{15}/cm^2$ or more. After the ion implantation, the silicon substrate 20 is annealed in a nitrogen atmosphere at about 700 to 1000° C. for about 30 min. Thereafter, the steps from FIG. 3C are performed to manufacture the device.

The manufacturing method shown in FIGS. 3A to 3F and 4 illustrate a device manufacturing method in which a mask for preventing boron diffusion is not formed in the mold holes 22 when the B diffusion layer 23 is formed. This manufacturing method has the advantages that the device manufacturing process can be greatly simplified (the structure having the contact pad 15 shown in FIG. 1 can be manufactured only by performing photolithography twice), and that a gate electrode 13 having a very small hole (diameter=about 0.5 $\mu$m) can be formed around the sharp tip 11*a* of the emitter electrode 11. The ability to decrease the hole size of the gate electrode 13 results in a great advantage of being able to decrease the voltage to be applied to the device.

Figure 5A:
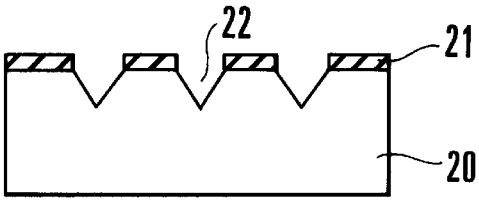
FIGS. 5A to 5F are sectional views showing the second example of the vacuum microdevice manufacturing method of the present invention.

FIGS. 5A to 5F illustrate the second example of the vacuum microdevice manufacturing method according to the present invention. In FIGS. 5A to 5F, a device manufacturing method by which a mask for a B diffusion layer is formed in mold holes is depicted in the order of steps. As shown in FIG. 5A, an oxide film 21 is selectively formed on a silicon substrate 20, and holes having dimensions of, e.g., 1 $\mu$m×1 $\mu$m are formed by using the oxide film 21 as a mask. The silicon substrate 20 is etched by using an anisotropic etching solution such as KOH or hydrazine, forming mold holes 22 having the shape of an inverted triangular pyramid.

Figure 5B:
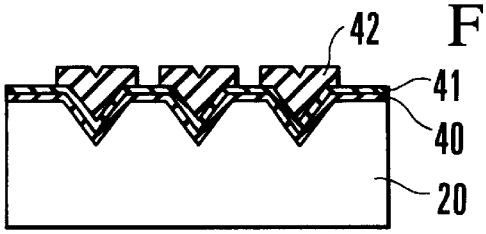

Subsequently, the oxide film 21 is removed and, as shown in FIG. 5B, an oxide film 40 and a nitride film 41 are sequentially formed on the surface of the silicon substrate 20. The oxide film 40 is formed by thermally oxidizing the silicon substrate 20 and has a thickness of, e.g., about 300 nm. The nitride film 41 is formed to have a thickness of about 100 nm by using low-pressure CVD (Chemical Vapor Deposition). A resist is then applied to form a resist pattern 42 in each mold hole 22. This resist pattern 42 has a thickness of about 3 $\mu$m and can be either slightly larger or smaller than the planar size of the mold hold 22.

Figure 5C:
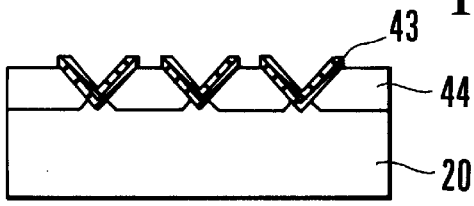

As shown in FIG. 5C, the resist pattern 42 is used as a mask to etch the nitride film 41 and the oxide film 40, thereby forming an insulating film pattern 43 on the mold hole 22. After the resist 42 is removed, boron is diffused at a high concentration into the silicon substrate 20 to form a B diffusion layer 44. This high-concentration diffusion of boron can be accomplished by opposing a solid source to the major surface in which the mold holes 22 are formed and heating the source at a temperature of about 1200° C. in an atmosphere containing nitrogen gas and oxygen mixed at a flow rate of about 3 to 10% of the flow rate of the nitrogen gas. During the boron diffusion, the nitride film 41 acts as a boron diffusion mask and also functions to prevent the boron-containing oxide film from flowing and burying the point of the mold hole 22. Therefore, the shape of the mold hole 22 hardly changes even in this boron diffusion step. Since, however, a thin oxide film is formed on the nitride film 41, further pointed mold holes can be obtained by additionally performing a step of removing this thin oxide film.

Figure 5D:
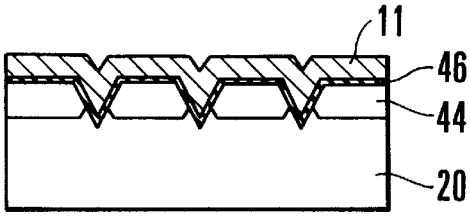
Figure 5E:
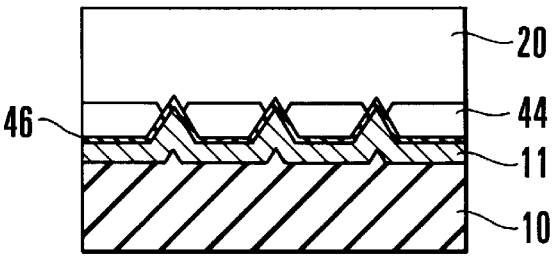

Subsequently, as shown in FIG. 5D, the silicon substrate 20 is oxidized to form an oxide film 46 about 300 nm thick on the surface of the substrate 20. An emitter electrode 11 is then deposited on the oxide film 46. As shown in FIG. 5E, the major surface of the silicon substrate 20 on which the emitter electrode 11 is formed is adhered to one surface of a structural substrate 10. If the structural substrate 10 is made from a glass material, the glass and the emitter electrode 11 can be strongly adhered by using electrostatic adhesion.

Figure 5F:
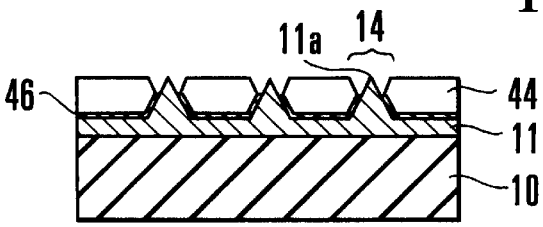

As shown in FIG. 5F, the silicon substrate 20 is removed while the B diffusion layer 44 is left behind by placing the sample in a solution, e.g., a hydrazine solution, whose etching rate depends upon the boron concentration. The end portions of the oxide film 46 exposed in current radiation regions 14 are removed by using hydrofluoric acid and hot phosphoric acid or a reactive gas such as $SF_6$ to expose sharp tips 11*a* of the emitter electrode 11. In the process of this example, high-concentration boron diffusion is performed by using a mask. Therefore, boron is drawn into the oxide film 40 during the diffusion of boron, so the structure shown in FIG. 2 can be manufactured.

Figure 6A:
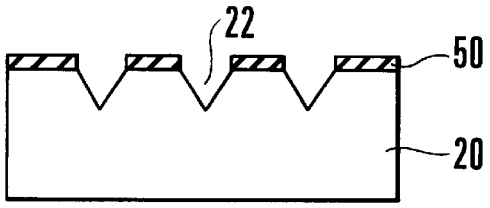
FIGS. 6A to 6F are sectional views showing the third example of the vacuum microdevice manufacturing method of the present invention.
Figure 6B:
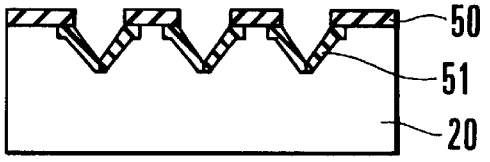
Figure 6C:
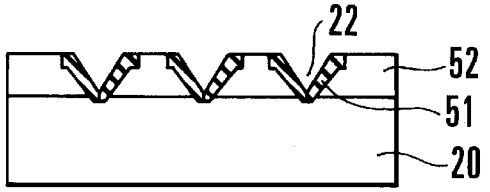

FIGS. 6A to 6F illustrate the third example of the vacuum microdevice manufacturing method according to the present invention. As shown in FIG. 6A, a nitride film 50 is selectively formed on a silicon substrate 20, and holes having dimensions of, e.g., 1 μm×1 μm are formed by using the nitride film 50 as a mask. The silicon substrate 20 is etched by using an anisotropic etching solution such as KOH or hydrazine, forming mold holes 22 having the shape of an inverted triangular pyramid. Subsequently, as shown in FIG. 6B, the silicon substrate 20 is oxidized in an electric oven to form an oxide film 51 on the surface of each mold hole 22. As shown in FIG. 6C, the nitride film 50 is removed from the silicon substrate 20, and boron is ion-implanted into the silicon substrate 20 by using the oxide film 51 as a mask. Additionally, annealing is performed to form a highly doped B diffusion layer 52.

Figure 6D:
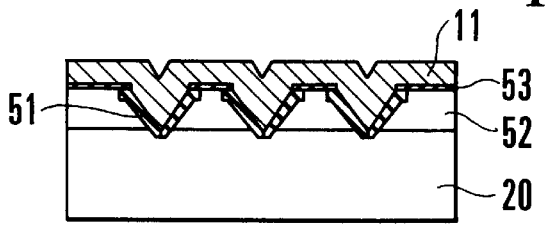
Figure 6E:
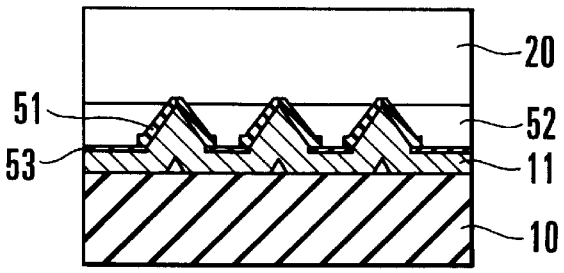
Figure 6F:
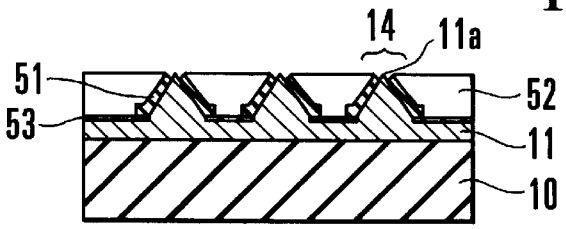

As shown in FIG. 6D, the silicon substrate 20 is oxidized in an atmosphere not containing hydrogen at a low temperature of about 800° C., thereby forming an oxide film 53 about 100 nm thick on the surface of the silicon substrate 20. Thereafter, an emitter electrode 11 is deposited on the oxide film 53. In FIG. 6E, the major surface of the silicon substrate 20 on which the emitter electrode 11 is formed is adhered to one surface of a structural substrate 10. If the structural substrate 10 is made from a glass material, the glass and the emitter electrode 11 can be strongly adhered by using an electrostatic adhesion method. In FIG. 5F, the silicon substrate 20 is removed while the B diffusion layer 52 is left behind by placing the sample in a solution, e.g., a hydrazine solution, whose etching rate depends upon the boron concentration. The end portions of the oxide film 51 exposed in current radiation regions 14 are removed by using hydrofluoric acid to expose sharp tips 11*a* of the emitter electrode 11.

This manufacturing process is very simplified compared to the process shown in FIGS. 5A to 5F, since a boron diffusion mask is formed on the mold holes 22 without using any photolithography. However, the oxide film 51 containing boron is also used in the subsequent process, so caution should be exercised to perform the subsequent process at a low temperature so that the borosilica glass does not flow. To completely prevent a shape change of the mold hole 22 caused by fluidization of the borosilica glass, it is sometimes effective to add a step of once completely removing all masks after the boron diffusion step shown in FIGS. 5C and 6C. Thereafter, an insulating film made from an oxide film is formed in a region including the mold hole 22 by the oxidation step shown in FIGS. 5D and 6D. Consequently, the emitter electrode 11 with a sharp tip can be formed without taking account of shape changes of the mold hole 22.

In the manufacturing methods of the first to third examples described above, a gate electrode is formed by using the difference between the etching rates of a heavily doped boron layer and a silicon substrate in an etching solution such as hydrazine. These manufacturing methods have the advantages that the shape of the gate electrode is readily controllable and the manufacturing cost is low because the process is extremely simple. However, when a highly doped B diffusion layer is used, holes diffusing from the p-type gate electrode reach the interior of an insulating film and readily causes recombination of electrons and holes in the interface between the insulating film and the emitter electrode. This makes an emission current difficult to produce. Also, an oxide film in which boron is diffused at a high concentration has a low withstand voltage. Accordingly, the device easily succumbs to short-circuiting. Manufacturing methods described below do not require the formation of this highly doped boron layer and further improve the voltage characteristic of the device.

Figure 7A:
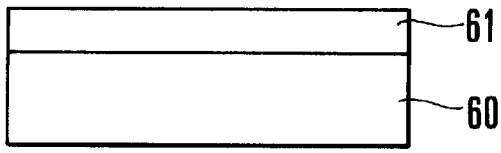
FIGS. 7A to 7F are sectional views showing the fourth example of the vacuum microdevice manufacturing method of the present invention.
Figure 7B:
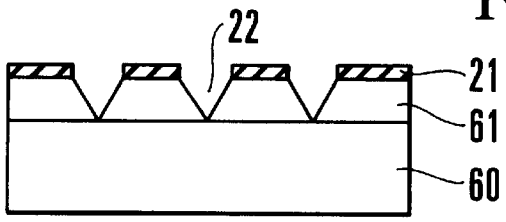
Figure 7C:
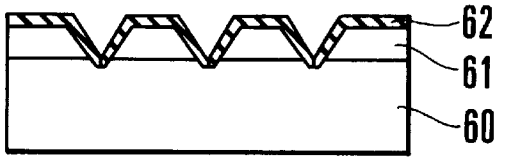

FIGS. 7A to 7F illustrate the fourth example of the vacuum microdevice manufacturing method according to the present invention. As shown in FIG. 7A, an n-type impurity diffusion layer 61 is formed on a silicon substrate 60 containing a p-type impurity. This n-type impurity diffusion layer 61 is formed by performing thermal diffusion in an atmosphere containing phosphorus such that a phosphorus diffusion layer is formed to have a thickness of about 1 μm. As shown in FIG. 7B, an oxide film 21 is selectively formed on the n-type impurity diffusion layer 61, and holes having dimensions of, e.g., 1 μm×1 μm are formed by using the oxide film 21 as a mask. The n-type impurity diffusion layer 61 of the p-type silicon substrate 60 is etched by using an anisotropic etching solution such as KOH or hydrazine, forming mold holes 22 having the shape of an inverted pyramid. Subsequently, as shown in FIG. 7C, the p-type silicon substrate 60 is oxidized in an electric oven to form an oxide film 62 on the surface of the p-type silicon substrate 60. The dimensions of the mold hole 22 and the steps shown in FIGS. 7A to 7C must be so adjusted that the end portion of the oxide film 62 formed in the mold hole 22 reaches the p-type silicon substrate 60.

Figure 7D:
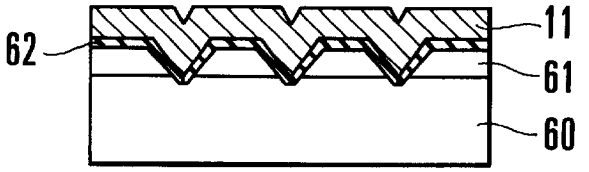
Figure 7E:
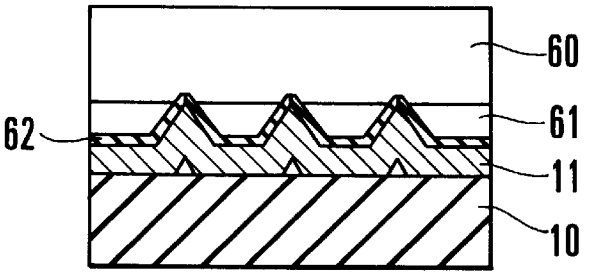
Figure 7F:
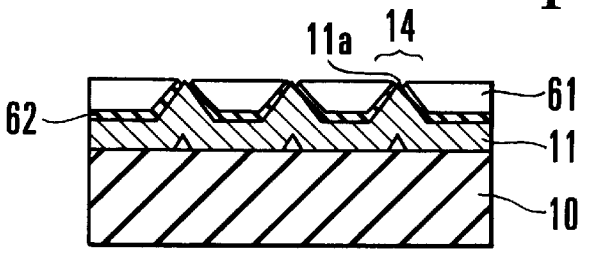

Thereafter, as shown in FIG. 7D, an emitter electrode 11 is deposited on the oxide film 62. In FIG. 7E, the major surface of the p-type silicon substrate 60 on which the emitter electrode 11 is formed is adhered to one surface of a structural substrate 10. If the structural substrate 10 is made from a glass material, the glass and the emitter electrode 11 can be strongly adhered by using electrostatic adhesion. In FIG. 7F, the sample is placed in a silicon etching solution such as a hydrazine solution, and a reverse bias voltage of about 10 V is applied between the n-type diffusion layer 61 and the etching solution. Consequently, the p-type silicon substrate 60 is removed while the n-type diffusion layer 61 is left behind. The end portions of the oxide film 62 exposed in current radiation regions 14 are removed by using hydrofluoric acid to expose tips 11*a* of the emitter electrode 11.

Figure 8A:
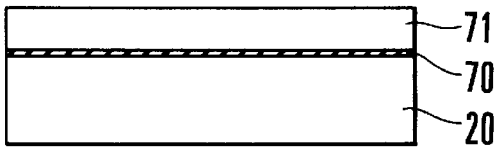
FIGS. 8A to 8F are sectional views showing the fifth example of the vacuum microdevice manufacturing method of the present invention.
Figure 8B:
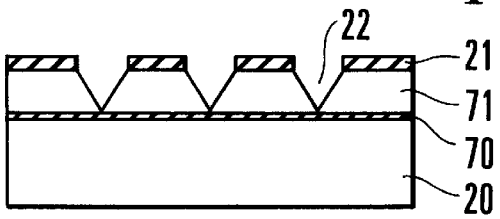
Figure 8C:
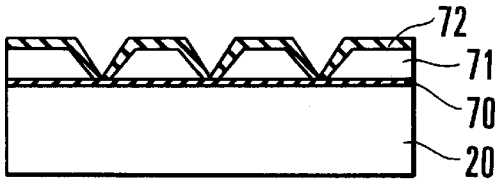

FIGS. 8A to 8F illustrate the fifth example of the vacuum microdevice manufacturing method according to the present invention. As shown in FIG. 8A, a silicon isolation layer 71 is formed on a silicon substrate 20 via an insulating film 70 such as an oxide film. This silicon isolation layer can be so formed as to have a thickness of about 1 μm by using a method of, e.g., SIMOX. As shown in FIG. 8B, an oxide film 21 is selectively formed on the silicon isolation layer 71, and holes having dimensions of, e.g., 1 μm×1 μm are formed by using the oxide film 21 as a mask. The silicon isolation layer 71 of the silicon substrate 20 is etched by using an anisotropic etching solution such as KOH or hydrazine, forming mold holes 22 having the shape of an inverted triangular pyramid. Subsequently, the oxide film 21 is removed, and the silicon substrate 20 is oxidized in an electric oven to form an oxide film 72 on the silicon isolation layer 71 as shown in FIG. 8C. The dimensions of the mold hole 22 must be so adjusted that the end portion of the oxide film 72 formed in the mold hole 22 reaches the insulating film 70 in the above steps.

Figure 8D:
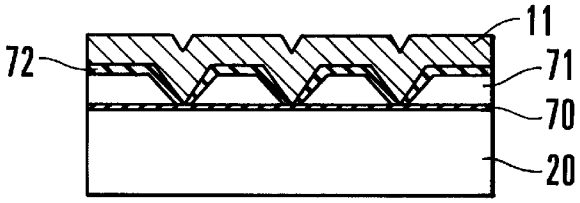
Figure 8E:
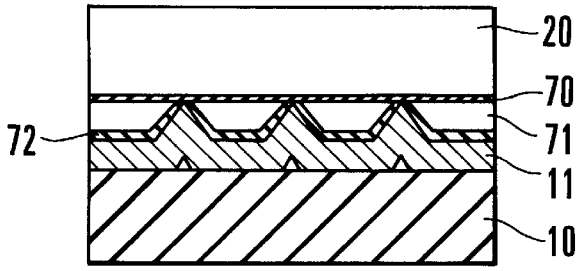
Figure 8F:
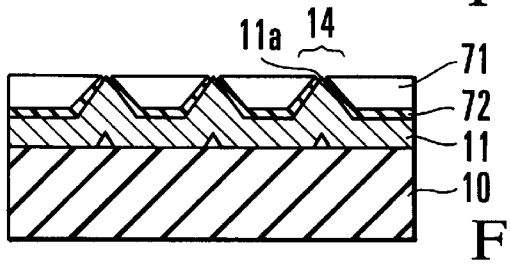
Figure 9:
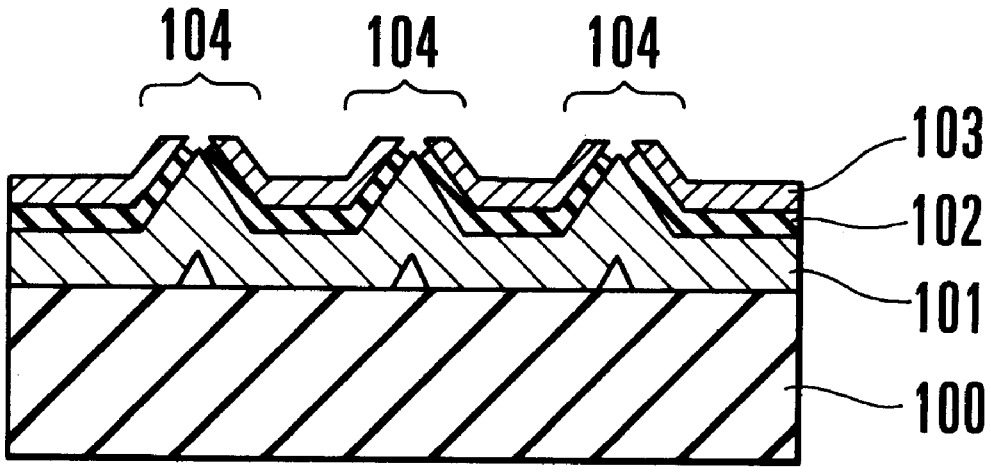
FIG. 9 PRIOR ART
FIG. 9 is a sectional view showing a conventional vacuum microdevice.

Thereafter, as shown in FIG. 8D, an emitter electrode 11 is deposited on the oxide film 72. In FIG. 8E, the major surface of the silicon substrate 20 on which the emitter electrode 11 is formed is adhered to one surface of a structural substrate 10. If the structural substrate 10 is made from a glass material, the glass and the emitter electrode 11 can be strongly adhered by using electrostatic adhesion. In FIG. 8F, the silicon substrate 20 is removed while the insulating film 70 and the silicon isolation layer 71 are left behind by placing the sample in a silicon etching solution such as a hydrazine solution. After the insulating film 70 is removed, the end portions of the oxide film 72 exposed in current radiation regions 14 are removed by using hydrofluoric acid to expose tips 11*a* of the emitter electrode 11.

In the manufacturing methods shown in FIGS. 7A to 7F and FIGS. 8A to 8F, a layer serving as a gate electrode is formed on a very flat sample before mold holes are formed. Therefore, the shape of the formed gate electrode is very flat. Consequently, the structure of the present invention as shown in FIG. 1 can be obtained.

Each of the above manufacturing methods is realized by applying a mold method to a silicon substrate having a thin silicon film structure with a thickness suitable for a gate electrode. Since the thin silicon film structure as a gate electrode is already formed on a sample in which an emitter electrode is buried, a gate electrode need not be deposited on an uneven surface unlike in conventional methods. Also, the thin silicon film as a gate electrode and the rest of the silicon substrate are separated by using the difference between properties, e.g., the difference between the impurity concentrations of silicon, the difference between the types of impurities, and the formation of a dielectric material between them. This obviates the need for an etch back process used in conventional methods. Consequently, the process is very simplified, and a uniform shape can be easily manufactured.

Figure 10A:
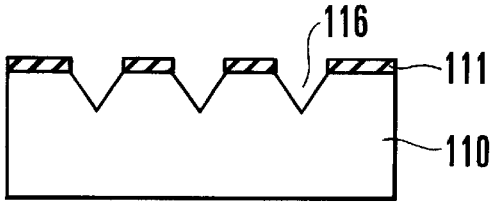
FIG. 10A PRIOR ART
FIGS. 10A to 10F are sectional views showing a conventional vacuum microdevice manufacturing method.
Figure 10B:
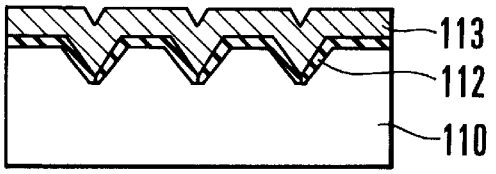
FIG. 10B PRIOR ART
Figure 10C:
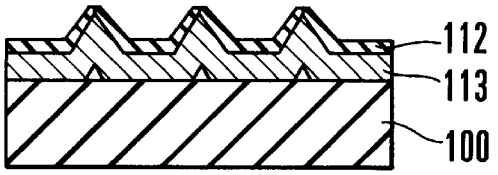
FIG. 10C PRIOR ART
Figure 10D:
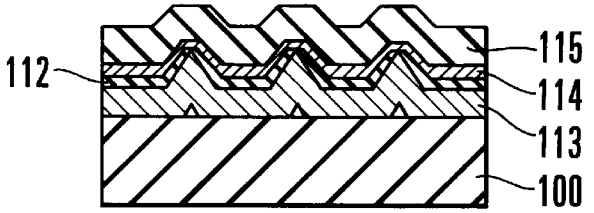
FIG. 10D PRIOR ART
Figure 10E:
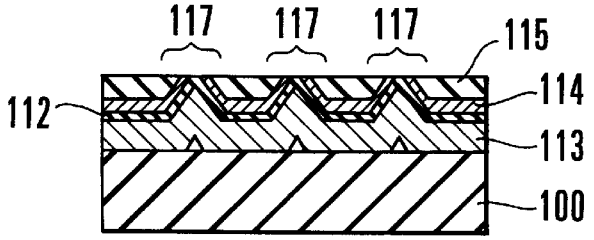
FIG. 10E PRIOR ART
Figure 10F:
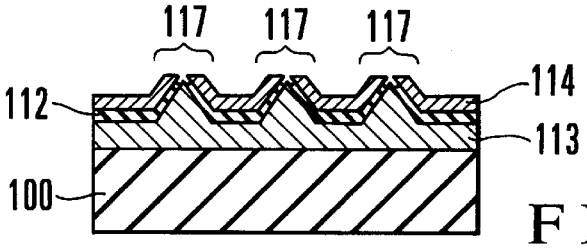
FIG. 10F PRIOR ART

In the structures and manufacturing methods described above, the gate electrode 13 can also be formed by using various metal materials. If this is the case, the above manufacturing methods cannot be directly used, but the structural problems of conventional structures can be overcome. To form the gate electrode 13 by using a metal material, it is possible to use, e.g., a method in which the gate metal 114 is deposited thick until the surface is considerably planarized in the step shown in FIG. 10D of the conventional manufacturing method, and the gate metal 114 is etched back without using the resist 115.

It is also possible to planarize the gate metal 114 by using the resist 115 and then etch back the gate metal 114. In this method the gate metal 114 must be deposited to have a thickness of 5 $\mu$m or more. However, when the gate metal 114 is deposited thick, the device deforms due to an increase of the internal stress, the process is prolonged, and the planarity of the gate electrode suffers. Nevertheless, the structure thus manufactured should be included in the structures of the present invention because this structure has a larger mechanical rigidity than those of conventional structures and well stabilizes the device characteristics.

As has been described above, in the vacuum microdevices of the present invention, the second electrode is so formed that its thickness increases away from the sharp tip of the first electrode. Since this increases the mechanical rigidity of the second electrode, an electrical short circuit hardly occurs even when a large electric field is applied between the second electrode and the sharp tip of the first electrode. Therefore, the life and reliability of the device can be increased. Also, deformation of the second electrode near the tip of the first electrode is suppressed. Accordingly, the relationship between the radiation current and the applied voltage obeys a Fowler-Nordheim relation (FN plot). Additionally, the device characteristics in individual current radiation regions can be uniformly controlled. As a consequence, the device design is facilitated, and a large current with uniform characteristics can be obtained.

In the manufacturing methods of the present invention, the thickness of the second electrode can be very accurately controlled over the entire surface. For example, diffusion of boron can be controlled between 0.1 to 30 $\mu$m with an accuracy of 0.05 $\mu$m or less by changing the diffusion time and temperature. Also, since the second electrode is formed in the step which is self-aligned with respect to the first electrode, the relative positional relationship between the two electrodes formed is extremely accurate. Additionally, no etch back process is used in the manufacturing methods of the present invention. This eliminates the problems of the etch back process, e.g., variations and the difficulty in locating the end point. This process improvement has the advantage that devices having uniform characteristics can be manufactured with simple manufacturing steps. Consequently, the time and cost for device development can be greatly reduced.

Furthermore, in the manufacturing methods of the present invention, the structure of the second electrode having very small holes can be manufactured by diffusing or implanting boron without using any mask. The electrical characteristics of devices manufactured by using molybdenum as the first electrode were actually measured. Consequently, while a current of about 100 $\mu$A was emitted from 100 arrays when a voltage of 100 V was applied to conventional devices, a current of 100 $\mu$A was emitted with an applied voltage of 40 V in devices manufactured by the method of the present invention. That is, the use of the manufacturing methods of the present invention has an effect of being able to provide a device capable of emitting a large current with a small applied voltage.

What is claimed is:

1. A vacuum microdevice comprising:

a first electrode serving as a cathode and having a sharp tip projecting in a current radiation region;

an insulating film formed on a surface of said first electrode except in a region of said tip of said first electrode; and a second electrode serving as a gate electrode and formed on said insulating film except said region of said tip and having an electrode thickness which increases with increasing radial distance from said tip of said first electrode in the current radiation region.

2. A vacuum microdevice according to claim 1, wherein said second electrode comprises silicon doped with boron at a concentration of not less than $5\times10^{19}$ $cm^{-3}$.

3. A vacuum microdevice according to claim 1, wherein said second electrode consists of silicon containing an n-type impurity.

4. A vacuum microdevice according to claim 1, wherein said substrate comprises a glass substrate, and said first electrode is fixed to said glass substrate by adhesion.

5. A vacuum microdevice according to claim 1, wherein said second electrode has a flat surface leveled with said tip of said first electrode.

6. A vacuum microdevice according to claim 1, wherein said second electrode has a flat surface higher than said tip of said first electrode outside said current radiation region and has a surface inclined downward toward said tip of said first electrode inside said current radiation region.

7. A vacuum microdevice according to claim 1, wherein said first electrode is an emitter electrode having a conical shape, and said second electrode is a gate electrode having a flat surface.

* * * * *